US005220798A

United States Patent [19]

Nagamura et al.

[11] Patent Number: 5,220,798

[45] Date of Patent: Jun. 22, 1993

[54] AIR SEPARATING METHOD USING EXTERNAL COLD SOURCE

[75] Inventors: Takashi Nagamura; Naohiko Yamashita, both of Kobe, Japan

[73] Assignee: Teisan Kabushiki Kaisha, Tokyo, Japan

[21] Appl. No.: 959,540

[22] Filed: Oct. 13, 1992

Related U.S. Application Data

[63] Continuation of Ser. No. 760,185, Sep. 16, 1991, abandoned.

[30] Foreign Application Priority Data

Sep. 18, 1990 [JP] Japan ..... 2-249840

[51] Int. Cl.[5] ..... F25J 3/02

[52] U.S. Cl. ..... 62/30; 62/37; 62/41; 62/50.2

[58] Field of Search ..... 62/8, 9, 11, 24, 40, 62/30, 50.2, 37

[56] References Cited

U.S. PATENT DOCUMENTS 3,535,210 10/1970 Linde et al. ..... 62/333
3,857,251 12/1974 Alleaume ..... 62/40
3,886,758 6/1975 Perrotin ..... 62/39
4,054,433 10/1977 Buffiere et al. ..... 62/40
4,192,662 3/1980 Ogata et al. ..... 62/40

FOREIGN PATENT DOCUMENTS 304355 7/1988 European Pat. Off. .
5315993 6/1976 Japan .
1376678 12/1974 United Kingdom .
1520581 8/1978 United Kingdom .

OTHER PUBLICATIONS

Yamanouchi et al.: Chemican Engineering Progress Jul. 1979 "Using LNG Cold for Air Separation".

*Primary Examiner*—Ronald C. Capossela
*Attorney, Agent, or Firm*—Oblon, Spivak, McClelland, Maier & Neustadt

[57] ABSTRACT

The invention concerns the separation of air with an external cold source. An internal cold source is provided to supply cold heat to a compressed inert gas by expansion of a part of a liquefied inert gas when the cold from the external cold source proves to be insufficient. This part of the liquefied inert gas is combined with recycling and compressed gases. The desired production of liquid oxygen and nitrogen is thus assured in spite of variations in the external cold source.

1 Claim, 2 Drawing Sheets

AIR SEPARATING METHOD USING EXTERNAL COLD SOURCE

This application is a continuation of application Ser. No. 07/760,185, filed on Sep. 16, 1991, now abandoned.

DETAILED DESCRIPTION OF THE INVENTION

Industrial Field of Application

The present invention relates to an air separating method using an external cold source, in which a recycle inert gas drawn from an air separating apparatus is compressed to a pressure for liquefaction through a heat exchange with an external cold source, the compressed inert gas is liquefied through an indirect heat exchange with the external cold source, the liquefied inert gas is introduced into the air separator apparatus, a cold heat necessary for air separation is supplied, and the gas is again drawn from the air separating apparatus as the recycle inert gas.

Prior Art

An amount of cold heat generated is variable with seasonal or hourly variations in the supply of liquefied natural gas or the like. Consequently, the air separating method depending for its external cold source on the cold heat generated by gasification of liquefied natural gas or the like has a problem that the air separating amount tends to vary. It is desirable to minimize the variations in the air separating amount while making full use of the external cold source.

According to an air separating method proposed to meet this requirement, part of liquid nitrogen manufactured in the air separating apparatus is constantly stored in a liquid nitrogen tank. When variations in the supply of liquefied natural gas are likely to result in a shortage of cold heat to reduce the air separating amount, the liquid nitrogen is supplied from the liquid nitrogen tank to a heat exchanger to compensate for the cold heat shortage. (see Patent Publication 1990-9274, for example).

Problem to be Solved by Invention

According to the above prior method, the insufficient cold heat is covered by part of the liquefied nitrogen manufactured in the air separating apparatus as a product. If the air separating apparatus is continuously run while only insufficient cold heat is supplied from the external cold source, the substantial separating ratio of the liquid nitrogen product will lower gradually. As a result, the manufacturing amount of liquid nitrogen alone will be reduced.

To solve this problem, it is conceivable to provide an additional cooling cycle using Freon, for example, as a refrigerant. The insufficient cold heat from the external cold source is covered by the cooling cycle. However, this measure has a disadvantage of raising equipment cost.

The present invention has been made having regard to the state of the art noted above. An object of the invention is to provide an air separating method using an external cold source, which facilitates a desired air separating amount obtained at a substantially constant separating ratio despite a shortage of cold heat available from an external cold source, while checking an increase in equipment cost, this being achieved by effectively using the process of compressing a recycle inert gas to a pressure for liquefaction through a heat exchange with the external cold source.

Means for Solving Problem

In order to achieve the above object, an air separating method using an external cold source as set forth in the introductory part hereof, according to the present invention, is characterized in that;

A. an internal cold source is provided to supply a cold heat to the compressed inert gas by expanding part of the liquefied inert gas, B. the compressed inert gas is liquefied to become the liquefied inert gas through an indirect heat exchange with both the external cold source and the internal cold source when the cold heat of the external cold source is insufficient, and C. the inert gas expanded to act as the internal cold source for supplying the cold heat to the compressed inert gas is joined with the recycle inert gas drawn from the air separating apparatus, this confluent inert gas being compressed to become the compressed inert gas.

This construction has the following functions and effects.

Functions a. According to the features A and B, part of the compressed inert gas is used to provide a cold heat for covering the insufficient cold heat when the external cold source provides an insufficient cold heat for liquefying a required quantity of compressed inert gas.

b. According to the feature C, a cold heat cycle is formed to cover the insufficient cold heat. In this cycle, part of the inert gas is used as a refrigerant which is compressed with the recycle inert gas drawn from the air separating apparatus to form a compressed inert gas. This compressed inert gas is cooled by the external cold source and internal cold source to become a liquefied inert gas. Part of this liquefied inert gas is expanded as the internal cold source to supply the lacking cold heat to the compressed inert gas. The inert gas as the expanded refrigerant is compressed again with the recycle inert gas drawn from the air separating apparatus.

EFFECT OF THE INVENTION

Thus, the cold heat cycle is formed with part of the inert gas acting as a refrigerant, by utilizing the process of compressing the recycle inert gas to a pressure for liquefaction through a heat exchange with the external cold source. A shortage of cold heat available from the external cold source may be compensated for by the cold heat cycle. Consequently, the invention facilitates a desired air separating amount obtained at a substantially constant separating ratio despite a shortage of cold heat available from the external cold source, while checking an increase in equipment cost.

An air separating method using an external cold source provides a detecting device for detecting a shortage of the cold heat of the external cold source, and a supply adjusting device for adjusting supply of the liquefied inert gas for the internal cold source are provided, the supply adjusting device being automatically operable in response to results of detection by the detecting device. A desired amount of air separation is secured more effectively than manual control of the supply adjusting device.

EMBODIMENT

An embodiment will be described next with reference to the drawings.

Figure 1:
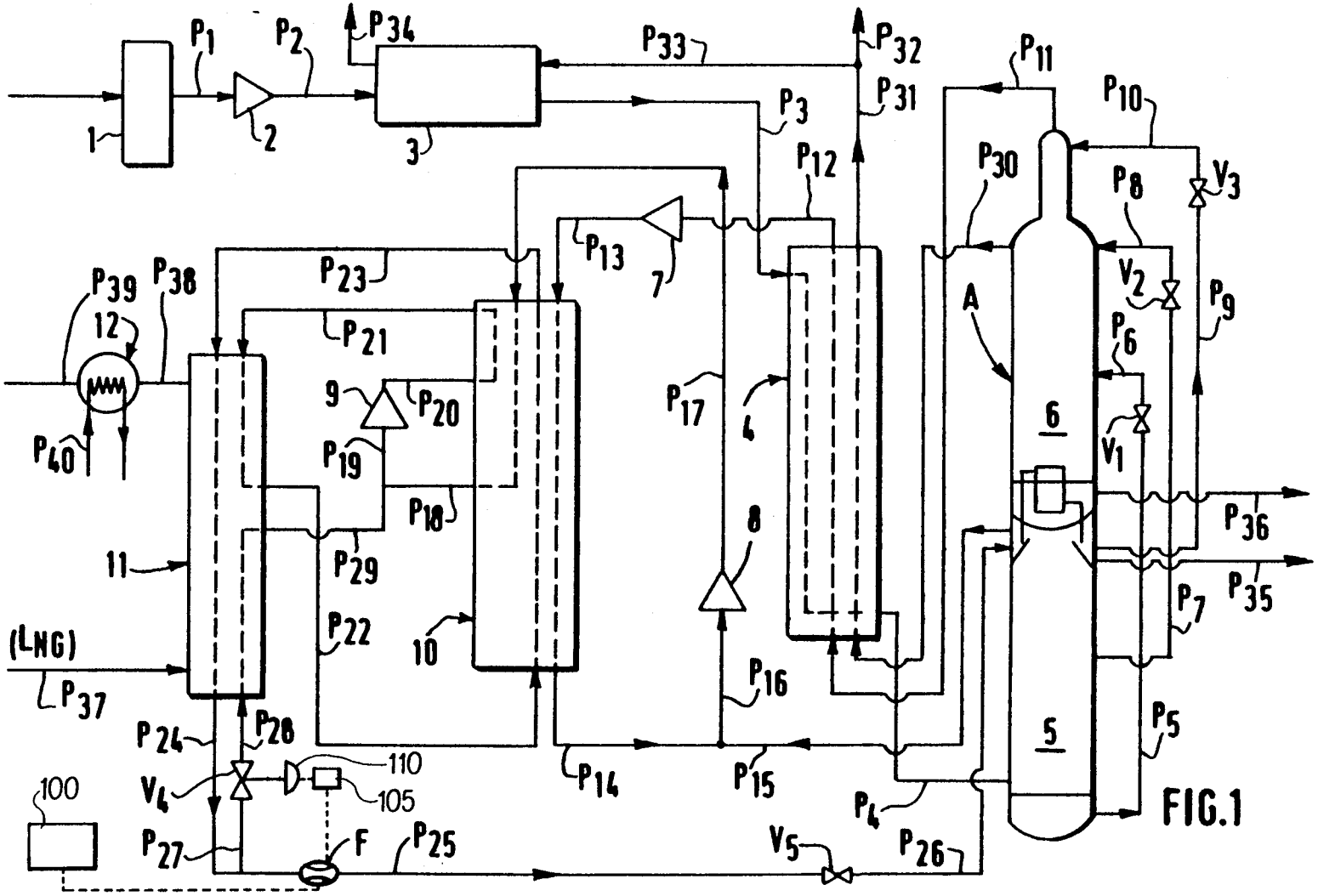
FIG. 1 is a system diagram illustrating an air separating method using an external cold source according to the present invention.

FIG. 1 is a system diagram illustrating an air separating method using an external cold source according to the present invention. Nitrogen gas is drawn as a recycle inert gas from an air separating apparatus A including a medium-pressure fractionating tower 5 and a low-pressure fractionating tower 6. This liquid nitrogen is compressed to a pressure for liquefaction through a heat exchange with liquefied natural gas (hereinafter referred to as LNG) acting as an external cold source. The compressed nitrogen gas is liquefied through an indirect heat exchange with the LNG. The resulting liquid nitrogen is introduced into the air separating apparatus to supply a cold heat necessary for air separation, and is again taken out of the air separating apparatus as the recycle nitrogen gas.

Raw material air is passed through an air filter 1 to be stripped of dust, and sent through a pipe P1 to an air compressor 2 to be compressed to a pressure of about 5 kg/cm$^2$ G. The compressed air is sent through a pipe P2 to a decarbonating and drying unit 3 to be stripped of carbon dioxide gas and moisture. Thereafter the air is sent through a pipe P3 to a heat exchanger 4.

The raw material air fed into the heat exchanger 4 is cooled to the vicinity of its liquefying point through heat exchanges with the recycle nitrogen gas supplied from the low-pressure fractionating tower 6 to the heat exchanger 4 through a pipe P11 and with exhaust gas supplied from the low-pressure fractionating tower 6 to the heat exchanger 4 through a pipe P30. Then the air is sent through a pipe P4 to a lower position of the medium-pressure fractionating tower 5 to be fractionated in the medium-pressure fractionating tower 5. As a result, nitrogen gas and liquid nitrogen are formed in a top portion of the medium-pressure fractionating tower 5, and an oxygen-rich liquid in a bottom portion thereof.

The oxygen-rich liquid collected in the bottom of the medium-pressure fractionating tower 5 is sent through a pipe P5 to an expansion valve V1 for free expansion, and is then sent through a pipe P6 to an intermediate position of the low-pressure fractionating tower 6.

Liquid nitrogen formed in an intermediate portion of the medium-pressure fractionating tower 5 is sent through a pipe P7 to an expansion valve V2 for free expansion, and is then sent through a pipe P8 to an upper position of the low-pressure fractionating tower 6.

Part of the liquid nitrogen formed in the top portion of the medium-pressure fractionating tower 5 is sent through a pipe P9 to an expansion valve V3 for free expansion, and is then sent through a pipe P10 to a top position of the low-pressure fractionating tower 6. The remainder is taken out through a pipe P35 as a liquid nitrogen product.

The low-pressure fractionating tower 6 receives heat at the bottom thereof from the medium-pressure fractionating tower 5, and produces nitrogen gas in an upper portion and liquid oxygen in a lower portion thereof. The liquid oxygen product is taken out through a pipe P36.

The exhaust gas sent to the heat exchanger 4 through the pipe P30 warmed to room temperature through the heat exchange with the raw material air. Part of the exhaust gas is discharged through a pipe P32, and the rest is sent through a pipe P33 to the decarbonating and drying unit 3 for use in regenerating the decarbonating and drying unit 3, which is thereafter discharged through a pipe P34.

The recycle nitrogen gas will be described next.

The recycle nitrogen gas sent from the top of the low-pressure fractionating tower 6 through the pipe P11 to the heat exchanger 4 is exchanged to room temperature and a pressure of about 0.1 kg/cm$^2$ G through the heat exchange with the raw material air. Then the nitrogen gas is sent through a pipe P12 to a cold low-pressure compressor 7 for compression to a pressure of about 5 kg/cm$^2$ G.

The recycle nitrogen gas compressed by the cold low-pressure compressor 7 is sent through a pipe P13 to a heat exchanger 10 to be cooled therein. The cooled recycle nitrogen gas is sent through a pipe P14 into confluence with recycle nitrogen gas at a pressure of about 5 kg/cm$^2$ G sent from the top of the medium-pressure fractionating tower 5 through a pipe P15. The confluent nitrogen gas is sent through a pipe P16 to a medium-pressure compressor 8 to be cold-compressed to a pressure of about 35 kg/cm$^2$ G.

The recycle nitrogen gas cold-compressed to the pressure of about 35 kg/cm$^2$ G is sent through a pipe P17 to the heat exchanger 10 to be cooled again. Then the nitrogen gas is sent through pipes P18 and P19 to a high-pressure compressor 9 to be cold-compressed to a pressure of about 60 kg/cm$^2$ G for liquefaction through a heat exchange with the external cold source.

The recycle nitrogen gas cold-compressed to the pressure of about 60 kg/cm$^2$ G is sent through a pipe P20 to the heat exchanger 10 to be stripped of the compression heat. Then the nitrogen gas is sent through a pipe P21 to a heat exchanger 11 where the nitrogen gas is cooled by the cold heat generated by temperature rise and gasification of LNG. Subsequently, the nitrogen gas is sent through a pipe P22 to the heat exchanger 10. After giving the cold heat to the recycle nitrogen gas sent thereto through the pipes P13, P17 and P20, the nitrogen gas is sent through a pipe P23 to the heat exchanger 11 again to be cooled and become liquid nitrogen. The liquid nitrogen is sent through a pipe P24 and a pipe P25 having a flowmeter F to an expansion valve V5. Then the liquid nitrogen expands with a pressure reduced to about 5 kg/cm$^2$ G. This liquid nitrogen is sent through a pipe P26 back to the top position of the medium-pressure fractionating tower 5.

The LNG acting as the external cold source is sent through a pipe P37 to the heat exchanger 11 to give its cold heat to the compressed nitrogen gas. The LNG thereby heated is sent through a pipe P38 to a heat exchanger 12 for a heat exchange with a refrigerant such as Freon. As a result, the LNG is gasified and sent through a pipe P39 to a natural gas pipe.

The refrigerant such as Freon fed to the heat exchanger 12 through a pipe P40 collects the superfluous cold heat of the LNG. The cooled refrigerant is used for various purposes not shown, such as cooling of the raw material air, cooling water or raw material argon.

This system includes an internal cold source, a detecting device for detecting a shortage of the cold heat of LNG acting as the external cold source, and a supply adjusting device for adjusting a ratio of the liquid nitrogen branched off for the internal cold source. The internal cold source is in the form of part of the liquid nitrogen is branched off through a pipe P27 to an expansion valve V4 having a controller. The expanded liquid nitrogen gives its cold heat to the compressed nitrogen gas sent to the heat exchanger 11 through the pipes P21 and P23.

The detecting device includes a comparing device 100 provided for the flowmeter F that measures a flow rate of liquid nitrogen through the pipe P25. The comparing device compares the flow rate measured by the flowmeter F with a predetermined flow rate of liquid nitrogen through the pipe P25 set for sufficiency of the cold heat of LNG. When the flow rate of liquid nitrogen measured by the flowmeter F is short of the predetermined flow rate, it is determined that there is a shortage of the cold heat necessary to the heat exchanger 11. A supply control signal based on this detection is output to a supply adjusting device 105.

The supply adjusting device 105 includes a controller 110 provided for the expansion valve V4. This controller varies the opening degree of the expansion valve V4 to control the quantity of liquid nitrogen flowing to the pipe P28. The opening degree of the expansion valve V4 is automatically controlled in response to the supply control signal from the comparing device provided for the flowmeter F. As a result, the branching ratio of liquid nitrogen flowing into the pipe P27 is automatically adjusted to compensate for the cold heat shortage to obtain desired quantities of liquid oxygen product and liquid nitrogen product.

When the detecting device detects a shortage of cold heat of the LNG at a pressure of 35kg/cm$^2$G or less which is necessary to the heat exchanger 11, the expansion valve V4 having the controller that receives the signal expands the liquid nitrogen at the pressure of about 60kg/cm$^2$G branched off into the pipe P27 to the pressure of about 35kg/cm$^2$G. The expanded liquid nitrogen flows through the pipe P28 and compensates for the cold heat shortage in the heat exchanger 11. Thereafter the nitrogen gas flows through a pipe P29 to join the nitrogen gas flowing through the pipe P18.

The confluent nitrogen gas is compressed by the high-pressure compressor 9, and the compressed nitrogen gas flows through the pipe P20, heat exchanger 10, pipe P21, heat exchanger 11, pipe P22, heat exchanger 10, pipe P23 and heat exchanger 11 again. Thus a cold heat cycle is formed in which the nitrogen gas is liquefied through the indirect heat exchanges both with LNG acting as the external cold source and with the internal cold source, part of the liquid nitrogen is expanded by the expansion valve V4 having the controller to compensate in the heat exchanger 11 for the shortage of cold heat from the LNG, the nitrogen gas expanded is compressed again with the recycle nitrogen gas by the high-pressure compressor 9 to become the compressed nitrogen gas. When the external cold source fails to provide sufficient cold heat, the liquid nitrogen product is temporarily reduced by a quantity corresponding to the flow rate of nitrogen gas recirculated in the cold heat cycle, but thereafter predetermined amounts of air separation are secured at a substantially constant ratio.

The compressive pressure of the medium-pressure compressor 8 is determined by the pressure of LNG available as the external cold source. The compressive pressure is set to 35kg/cm$^2$G when the pressure of LNG is 35kg/cm$^2$G or less. When the pressure of LNG is higher than 35kg/cm$^2$G, the compressive pressure is set higher than the LNG pressure.

Different Embodiment

Figure 2:
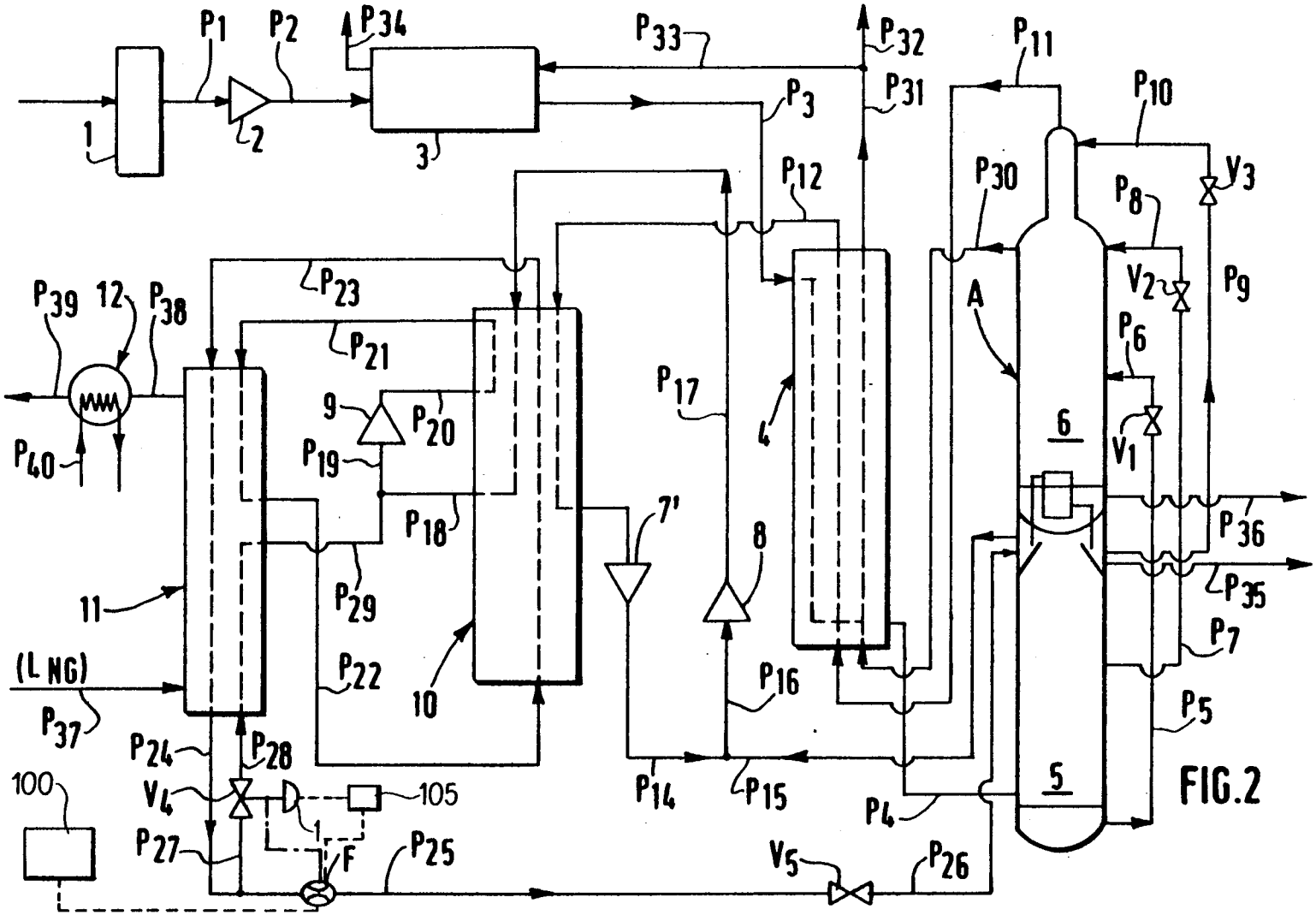
FIG. 2 is a system diagram of different embodiment.

As shown in FIG. 2, the cold low-pressure compressor 7 in the first embodiment may be replaced by a cold low-pressure compressor 7' mounted on the pipe P14 to compress, with less power consumption, the cold recycle nitrogen gas flowing from the heat exchanger 10.

In this case, the nitrogen gas at room temperature flows from the heat exchanger 4 through the pipe P12 to the heat exchanger 10 to be cooled. Then the nitrogen gas is compressed by the cold low-pressure compressor 7' from the pressure of about 0.1 kg/cm$^2$G to the pressure of about 5 kg/cm$^2$G.

The recycle nitrogen gas may be further cooled by the heat exchanger 10 at an intermediate step in or after compression by the cold low-pressure compressor 7'.

The other aspects of construction are the same as in the first embodiment.

OTHER EMBODIMENTS

A. The recycle inert gas is not limited to nitrogen gas but may be coarse argon gas.

B. The air separating apparatus may be used for separating coarse argon besides liquid nitrogen and liquid oxygen.

C. A detecting device for detecting a shortage of cold heat of the external cold source is not limited with regard to the construction. This detecting device may comprise a device for measuring flow rate and/or temperature of LNG, and a comparator circuit for comparing measurements provided by the measuring device and a predetermined value.

Although the claims include references for expediency of comparison with the drawings, such inclusion does not limit the present invention to the constructions shown in the drawings.

What is claimed as new to be secured by Letters Patent of the United States:

1. An air separating method comprising the steps of:

drawing a recycle inert gas from an air separation apparatus;

compressing the inert gas to a pressure for liquefaction through a heat exchanged with an external cold source which supplies a cold heat flow;

forming a liquefied inert gas by liquefying the compressed inert gas through an indirect heat exchange with the external cold source;

comparing the flow of the liquefied inert gas with a predetermined flow value;

introducing the liquefied inert gas to the air separation apparatus to supply a cold heat necessary for air separation; and redrawing an inert gas from the air separation apparatus;

said process comprising the further steps of:

expanding a portion of said liquefied inert gas to provide an internal cold source when said flow of the liquefied inert gas is below said predetermined flow value;

joining said expanded liquefied inert gas with said recycled inert gas and compressing said joined gases to form said compressed inert gas; and forming said liquefied inert gas by liquefying the compressed inert gas through an indirect heat exchange with both said external cold source and said internal cold source.

* * * * *